US009564701B2

(12) United States Patent
Hotea et al.

(10) Patent No.: US 9,564,701 B2
(45) Date of Patent: Feb. 7, 2017

(54) PLUG CONNECTOR

(75) Inventors: Gabriel Hotea, Offenbach (DE); Guenther Mumper, Egelsbach (DE); Hartmut Ripper, Darmstadt (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/119,812

(22) PCT Filed: May 15, 2012

(86) PCT No.: PCT/EP2012/059007
§ 371 (c)(1),
(2), (4) Date: Nov. 22, 2013

(87) PCT Pub. No.: WO2012/163669
PCT Pub. Date: Dec. 6, 2012

(65) Prior Publication Data

US 2014/0099807 A1 Apr. 10, 2014

(30) Foreign Application Priority Data

May 27, 2011 (DE) ..... 10 2011 076 568

(51) Int. Cl.
*H01R 13/44* (2006.01)
*H01R 13/629* (2006.01)

(52) U.S. Cl.
CPC ..... *H01R 13/44* (2013.01); *H01R 13/62955* (2013.01); *H01R 13/62944* (2013.01)

(58) Field of Classification Search
CPC ..... H01R 13/629; H01R 13/62938
(Continued)

(56) References Cited

U.S. PATENT DOCUMENTS 6,319,050 B1 * 11/2001 Miyazaki ..... H01R 13/62938 439/157
6,832,922 B2 * 12/2004 Kozono et al. ..... 439/135
(Continued)

FOREIGN PATENT DOCUMENTS

CN 1697267 A 11/2005
CN 101044658 A 9/2007
(Continued)

OTHER PUBLICATIONS

International Preliminary Report on Patentability issued by The International Bureau of WIPO, Geneva, Switzerland, dated Jan. 14, 2014, for International Application No. PCT/EP2012/059007; 5 pages.

(Continued)

*Primary Examiner* — Amy Cohen Johnson
*Assistant Examiner* — Oscar C Jimenez
(74) *Attorney, Agent, or Firm* — Faegre Baker Daniels LLP

(57) ABSTRACT

A plug connector has a housing with a cap, the cap having a lever which can adopt a first position and a second position. In this case, the housing is opened in the first position of the lever and closed in the second position of the lever. Furthermore, the plug connector has a locking device which can adopt a blocking position which is intended to lock the lever in the second position. The locking device is elastically movable out of its blocking position into a release position in order to unlock the lever in the second position. Furthermore, the locking device is elastically movable out of its blocking position into an overload position in order to unlock the lever in the second position if a force exerted on the lever exceeds a set value. In this case, the overload position differs from the release position.

22 Claims, 5 Drawing Sheets

(58) Field of Classification Search
USPC ..... 439/157, 372, 131, 587
See application file for complete search history.

(56) References Cited

U.S. PATENT DOCUMENTS

| | | | | |
|---|---|---|---|---|
| 7,137,835 | B2 | 11/2006 | Shiga | |
| 7,234,952 | B2 * | 6/2007 | Sasaki et al. | 439/157 |
| 8,662,906 | B2 * | 3/2014 | Schmitt et al. | 439/157 |
| 2005/0026484 | A1 * | 2/2005 | Demuth | 439/157 |
| 2006/0040535 | A1 | 2/2006 | Koshy et al. | |
| 2006/0228921 | A1 * | 10/2006 | Fukui et al. | 439/157 |

FOREIGN PATENT DOCUMENTS

| | | | |
|---|---|---|---|
| JP | 2010 108872 | A | 5/2010 |
| WO | WO 2011006821 | A1 * | 1/2011 |

OTHER PUBLICATIONS

International Search Report and Written Opinion, European Patent Office, dated Dec. 6, 2013, for International Application No. PCT/EP2012/059007; 8 pages.

English translation of the First Office Action issued by the State Intellectual Property Office of the People's Republic of China, dated Oct. 28, 2015, for Chinese Application No. 201280025705.8 (Issuing No. 201510230072251O); 9 pages.

English translation of the Second Office Action issued by the State Intellectual Property Office of the People's Republic of China, dated Jun. 21, 2016, for Chinese Patent Application No. 201280025705.8; 11 pages.

* cited by examiner

PLUG CONNECTOR

The invention relates to a plug connector with a closable housing with a locking device in accordance with the preamble of claim 1.

BACKGROUND OF THE DISCLOSURE

Electrical plug connectors and plug-connector systems are known in diverse embodiments from the prior art. There are plug connectors in which a lever has to be thrown in order to close a housing of the plug connector and/or to produce an electrical connection. It is also known to lock such a lever in its closed position by means of a locking mechanism. In order to move the lever which is locked in the closed position back into its open position, first of all the locking mechanism has to be released. It has been shown that incorrect operation of such plug connectors, for example an attempt to move the locked lever into the open position without releasing the locking mechanism beforehand, can result in damage to the locking mechanism and hence to the entire plug connector.

The object of the present invention is to provide an improved plug connector. This object is achieved by a plug connector having the features of claim 1. Preferred developments are set forth in the dependent claims.

A plug connector according to the invention has a housing with a cap, the cap in turn having a lever which can adopt a first position and a second position. In this case, the housing is opened in the first position of the lever and closed in the second position of the lever. The plug connector further has a locking device which can adopt a blocking position which is intended to lock the lever in the second position. Furthermore, the locking device is elastically movable out of its blocking position into a release position in order to unlock the lever in the second position. Furthermore, the locking device is elastically movable out of its blocking position into an overload position in order to unlock the lever in the second position if a force exerted on the lever exceeds a set value. In this case, the overload position differs from the release position. Advantageously, with this plug connector the lever is also released from the second position when the locking device has not previously been moved into the release position, but a force exerted on the lever exceeds a set minimum value. This advantageously avoids damage to the locking device, the lever or other components of the plug connector which would otherwise be a risk. Advantageously, the plug connector is then still functional even after incorrect operation or inadvertent opening of the lever.

SUMMARY OF THE DISCLOSURE

In a preferred embodiment of the plug connector, the locking device has a latch projection. Advantageously, a latch projection is highly suitable for locking the lever in its second position.

It is expedient for the lever in its second position to lie against the latch projection. Advantageously, the latch projection then brings about reliable locking of the lever in its second position.

In a particularly preferred embodiment of the plug connector, the locking device is movable out of the blocking position into the release position by pressing-in the latch projection. Advantageously this embodiment permits simple and intuitive unlocking of the locking device in the second position of the lever.

It is expedient for the locking device to have a bar-shaped section and for the latch projection to be arranged on a longitudinal end of the bar-shaped section. Advantageously, the bar-shaped section of the locking device then permits elastic deformation of the locking device in order to move the locking device out of its blocking position both into the release position and into the overload position. Owing to the elastic deformability of the locking device, advantageously damage to the locking device is avoided.

Particularly preferably, the locking device has a recess. Advantageously, the recess can increase the elastic deformability of the locking device, which prevents inelastic, non-reversible deformation of the locking device.

It is likewise preferable for the locking device to have a reinforcing rib. Advantageously, a reinforcing rib also improves the elastic properties of the locking device. Furthermore, the reinforcing rib can advantageously partially dissipate forces acting on the locking device into the area around the locking device, which advantageously effectively prevents damage to the locking device.

In one embodiment of the plug connector, the lever is pivotable about a rotation spindle. Advantageously, the lever can then be moved between the first position and the second position by pivoting about the rotation spindle.

In a particularly preferred embodiment of the plug connector, the lever has teeth which are arranged along an arc of a circle about the rotation spindle. Advantageously, turning the lever about the rotation spindle then brings about turning of the teeth about the rotation spindle, by which the movement of the lever can be transmitted to further components of the plug connector which are engaged with the teeth of the lever. Advantageously, the movement of the lever can then serve for closing and opening the plug connector, and also for producing and releasing an electrical connection brought about by the plug connector.

In an expedient embodiment of the plug connector, the locking device is arranged on the cap. Advantageously, this embodiment permits particularly simple manipulation of the plug connector, since placing of the cap on a further part of the housing of the plug connector and closing of the housing can then take place in a joint operation.

Particularly preferably, the locking device and the cap are formed in one piece. Advantageously, this simplifies the manipulation of the plug connector, since merely a common component has to be manipulated for closing the plug connector.

Advantageously, the one-piece configuration of the locking device and cap furthermore prevents one of the components from being lost during wiring or maintenance work. The one-piece configuration of the locking device and cap advantageously furthermore reduces the production costs, and also the transportation and storage costs.

It is expedient for the cap and/or the locking device to consist of plastics material. Advantageously, plastics material represents an inexpensive material, and offers suitable elastic properties.

In one embodiment of the plug connector, the cap and/or the locking device are produced by injection moulding. Advantageously, injection moulding represents an inexpensive production method which is suitable for mass production.

The invention will be explained in greater detail below with reference to figures. Therein:

DETAILED DESCRIPTION OF THE DRAWINGS

Figure 1:
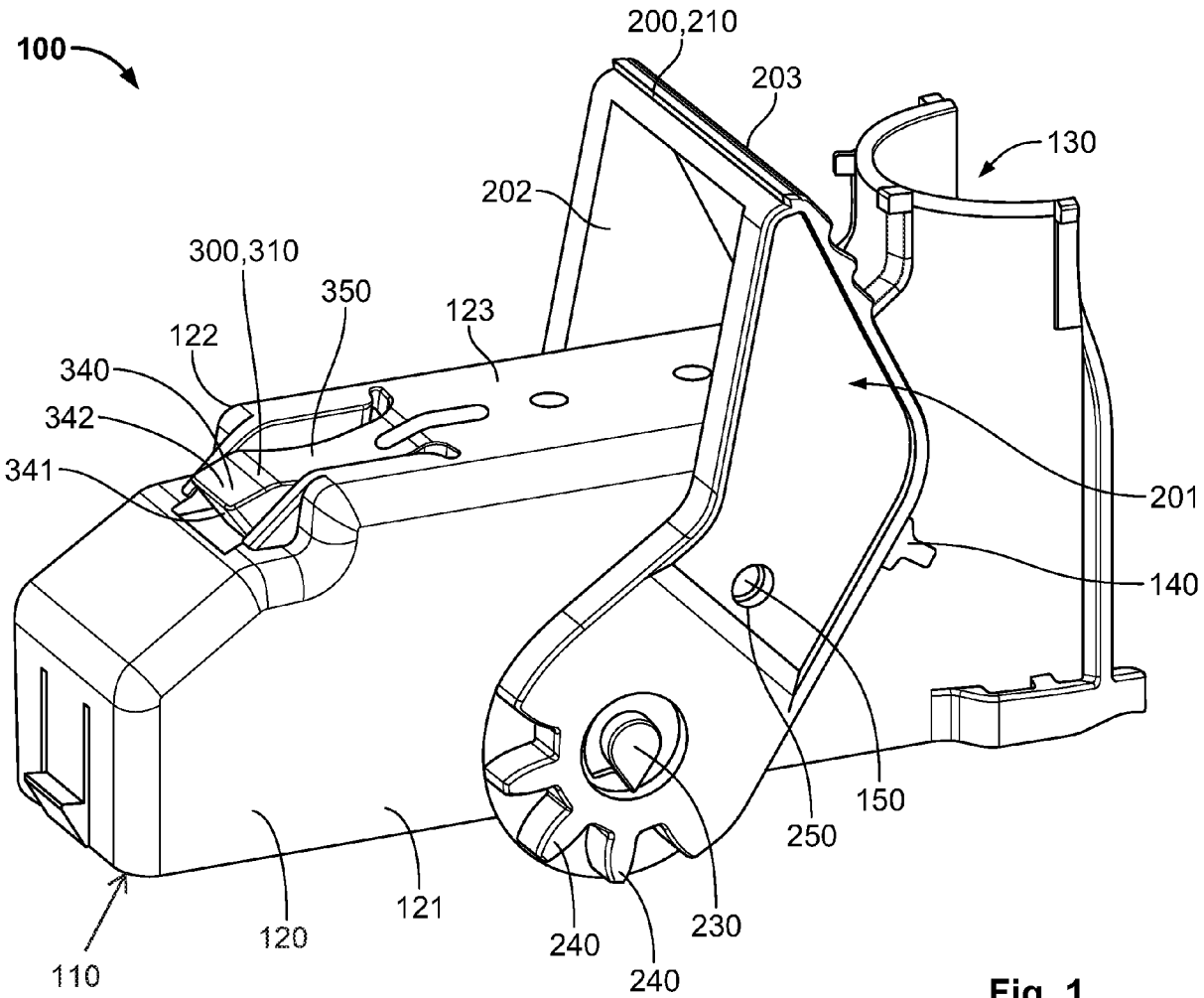
FIG. 1 is a perspective view of part of a cap of a housing of a plug connector with a lever in a first position.

FIG. 1 shows a perspective view of part of a cap 120 of a housing 110 of a plug connector 100. The plug connector 100 may for example serve for producing an electrical connection in a motor vehicle. The plug connector 100 may for example serve for producing an electrical connection with an electrical energy storage means of an electric or hybrid vehicle.

The plug connector 100 has a multipart housing 110, of which merely a cap 120 is illustrated in FIG. 1. In order to produce an electrical connection by means of the plug connector 100, the cap 120 is connected to the other sections of the housing 110 and the housing 110 is closed. The housing 110 is closed by means of a lever 200. By closing the housing 110, an electrical connection can be produced in various ways which are known from the prior art.

The cap 120 of the housing 110 of the plug connector 100 has a first side wall 121, a second side wall 122 located opposite the first side wall 121 and a top wall 123 extending between the first side wall 121 and the second side wall 122. Furthermore, the cap 120 of the housing 110 has a strain relief device 130 in which for example an electric cable can be guided and held.

The lever 200 is approximately U-shaped and has a first arm 201 and a second arm 202 parallel to the first arm 201. The first arm 201 and the second arm 202 are connected together via an operating region 203. The first arm 201 of the lever 200 is oriented parallel to the first side wall 121 of the cap 120 and is adjacent to the first side wall 121, and is connected rotatably to the first side wall 121 in the region of a rotation spindle 230. The second arm 202 of the lever 200 is oriented parallel to the second side wall 122 of the cap 120, is adjacent to the second side wall 122, and is connected rotatably to the second side wall 122 in the region of the rotation spindle 230. The operating region 203 extends across the top wall 123 of the cap 120.

Figure 2:
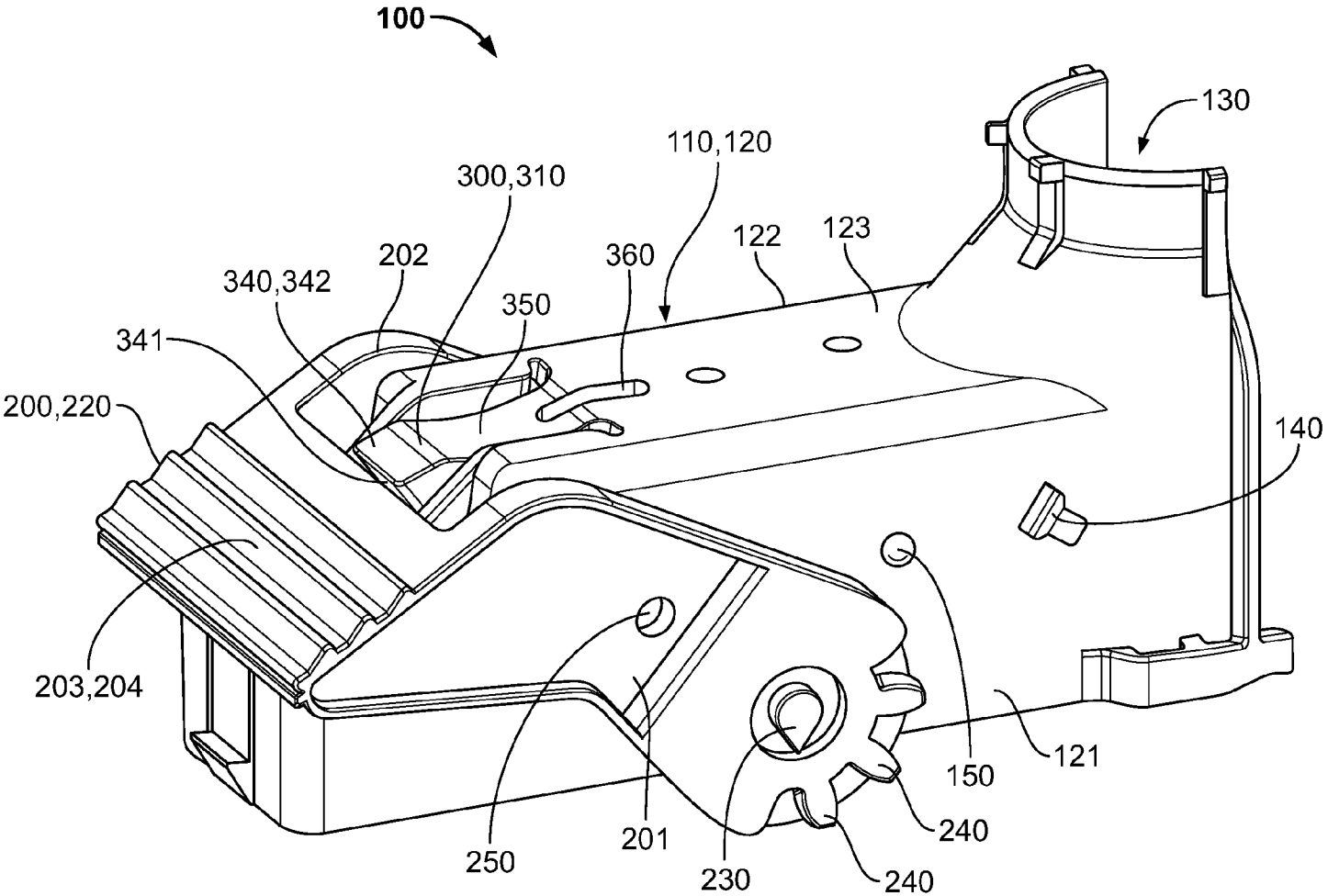
FIG. 2 is a perspective view of the cap of the housing of the plug connector with the lever in a second position.

The lever 200 is rotatable about the rotation spindle 230, and can be moved back and forth between a first position 210 and a second position 220. FIG. 1 shows the lever 200 in its first position 210. FIG. 2 shows a further perspective view of the cap 120 of the housing 110 of the plug connector 100, in which the lever 200 is in its second position 220. In the first position 210 of the lever 200, the housing 110 is opened and an electrical connection which can be produced by the plug connector 100 is broken. The first position 210 can thus be referred to as an open position. In the second position 220 of the lever 200, the housing 110 is closed and the electrical connection which can be produced by the plug connector 100 is likewise closed. The second position 220 can thus be referred to as a closed position.

The movement of the lever 200 is limited in the first position 210 of the lever 200 by a stop 140 arranged on the first side wall 121 of the cap 120. The stop 140 is arranged such that the first arm 201 of the lever 200 lies against the stop 140 if the lever 200 is in the first position 210. The stop 140 causes the lever 200 to be able to be moved out of its second position 220 into the first position 210, but not beyond the first position 210. A corresponding stop 140, not visible in FIGS. 1 and 2, can also be arranged on the second side wall 122 of the cap 120.

Furthermore, the first side wall 121 of the cap 120 has a knob 150 which is formed as a rounded-off hemispherical projection of the first side wall 121. The first arm 201 of the lever 200 has a hole 250, the dimensions of which correspond to those of the knob 150. In the first position 210 of the lever 200 illustrated in FIG. 1, the knob 150 of the first side wall 121 latches in the hole 250 in the first arm 201 of the lever 200 in order to fix the lever 200 in the first position 210. This advantageously prevents the lever 200 from swinging back and forth disruptively between its first position 210 and its second position 220 during the assembly of the plug connector 100. The fixing of the lever 200 in the first position 210 by the knob 150 and the hole 250 can however be released by a user without great expenditure of force by pushing the lever 200 out of the first position 210 in the direction of the second position 220. The second side wall 122 of the cap 120 may have a corresponding knob 150, not visible in FIGS. 1 and 2. In this case, the second arm 202 of the lever 200 also has a corresponding hole 250.

Both the stop 140 and the knob 150 and the hole 250 can be omitted in simplified embodiments.

The first arm 201 of the lever 200 furthermore has a plurality of teeth 240 which are arranged on a longitudinal end of the first arm 201 which is located opposite the operating region 203, close to the rotation spindle 230 and approximately along the arc of a circle about the rotation spindle 230. The second arm 202 of the lever 200 also has corresponding teeth, but these are not visible in FIGS. 1 and 2.

The teeth 240 are formed like the teeth of a gear wheel, and may engage with further teeth or other components of the plug connector 100. A movement of the lever 200 between its first position 210 and its second position 220 can be transmitted to other parts of the plug connector 100 via the teeth 240 in order to effect closing or opening of the plug connector 100 and making or breaking of an electrical connection brought about by the plug connector 100. Appropriate mechanisms are known from the prior art.

The operating region 203 of the lever 200 has a plurality of ribs 204 by which the operating region 203 is made easier to grip, and which thereby simplify manipulation of the lever 200 for a user of the plug connector 100. The ribs 204 could however also be omitted or be replaced by other configurations of the operating region 203.

The cap 120 of the housing 110 of the plug connector furthermore has a locking device 300. The locking device 300 serves to lock the lever 200 when the lever 200 is in its second position 220; the housing 110 of the plug connector 100 is therefore closed by the lever 200. The locking of the lever 200 in its second position 220 means that the lever 200 cannot be readily moved back again into its first position 210; the housing 110 of the plug connector 100 cannot therefore be unintentionally opened and an electrical connection brought about by the plug connector 100 cannot be unintentionally broken.

The locking device 300 is arranged on the cap 120 of the housing 110 of the plug connector 100 and is formed in one piece with the cap 120 of the housing 110 of the plug connector 100. The locking device 300 could however also be provided at a different point on the plug connector 100.

The locking device 300 has a bar-shaped section 350, the first longitudinal end of which merges into the top wall 123 of the cap 120 and the second longitudinal end of which has a latch projection 340. The latch projection 340 in turn has an actuating region 342 and a contact surface 341. It can be seen in FIG. 2 that the latch projection 340 of the locking device 300 is arranged such that the operating region 203 of the lever 200 lies right next to the contact surface 341 of the latch projection 340 of the locking device 300 if the lever 200 is in its second position 220; the housing 110 of the plug connector 100 is therefore closed by the lever 200. Owing to the location of the operating region 203 of the lever 200 right next to the contact surface 341 of the latch projection 340, pivoting of the lever 200 out of the second position 220 back into the first position 210 is prevented. If an attempt is made to move the lever 200 in the direction of the first position 210, the operating region 203 of the lever 200 strikes the contact surface 341 of the latch projection 340. The lever 200 is thus locked in the second position 220.

Figure 3:
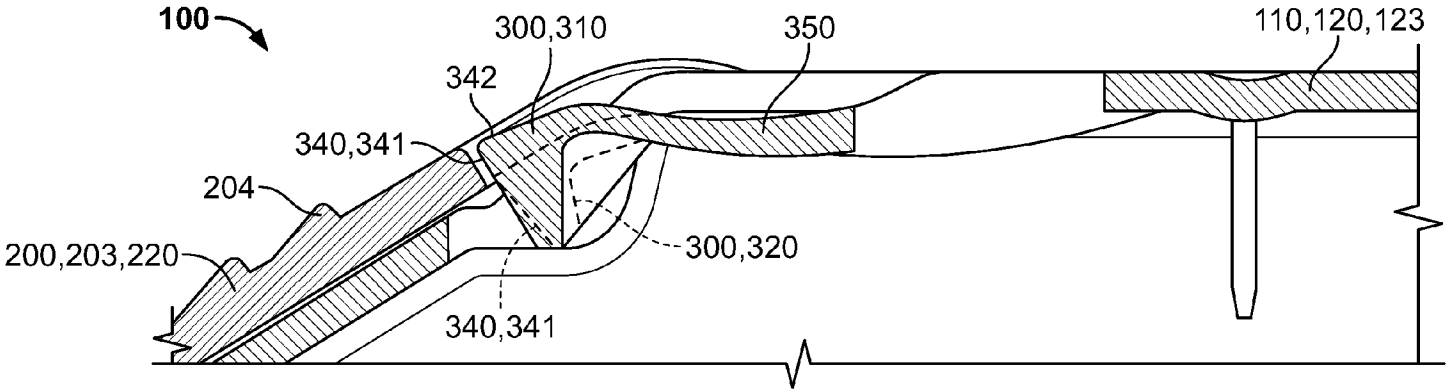
FIG. 3 is a section through the cap of the housing with a locking device in a blocking position and a release position.

FIG. 3 shows a first section through the cap 120 of the housing 110 of the plug connector 100 with the locking device 300. The locking device 300 is in a blocking position 310 which the locking device 300 adopts if no external forces are acting on the locking device 300. It can be recognised that the operating region 203 of the lever 200 which is in the second position 220 lies against the contact surface 341 of the latch projection 340 of the locking device 300 or at least is located right next to the contact surface 341 of the latch projection 340. If an attempt is made to move the lever 200 in this situation into the first position 210, the operating region 203 of the lever 200 butts against the contact surface 341 of the latch projection 340, which prevents further movement of the lever 200.

Further, the locking device 300 is illustrated in a release position 320 in broken lines in FIG. 3. In its release position 320, the locking device 300 is elastically deformed relative to its blocking position 310. The elastic deformation of the locking device 300 in this case is achieved substantially by the bar-shaped section 350 of the locking device 300. The locking device 300 can be bent out of its blocking position 310 into its release position 320 by exerting a force directed in the direction of the interior of the housing 110 of the plug connector 100 onto the actuating region 342 of the latch projection 340. The force can for example be exerted by a user of the plug connector 100 pressing with a finger on the actuating region 342 of the latch projection 340.

In the release position 320, the locking device 300 is deformed such that the latch projection 340 is located further within the housing 110 of the plug connector 100 than in the blocking position 310. This means that the contact surface 341 of the latch projection 340 in the release position 320 is no longer right next to the operating region 203 of the lever 200. Consequently, the lever 200 can be moved out of the second position 220 into the first position 210 without the operating region 203 of the lever 200 butting against the contact surface 341 of the latch projection 340 of the locking device 300.

Thus the lever 200 can be unlocked by exerting a force on the actuating region 342 of the latch projection 340 of the locking device 300 in its second position 220. If the exertion of a force on the actuating region 342 of the latch projection 340 is discontinued, the user of the plug connector 100 therefore stops pressing on the actuating region 342 of the latch projection 340, then the locking device 300 moves back out of its release position 320 again elastically into its blocking position 310.

Upon closing the lever 200 out of its first position 210 into its second position 220, the operating region 203 of the lever 200 slides over the latch projection 340 of the locking device 300, which causes the locking device 300 to be moved briefly out of its blocking position 310 into its release position 320 by the lever 200. This means that the operating region 203 of the lever 200, upon moving the lever 200 into the second position 220, can slide past the latch projection 340. If the lever 200 has completely arrived in its second position 220, the locking device 300 automatically moves elastically back into its blocking position 310, which locks the lever 200 in the second position 220.

Figure 4:
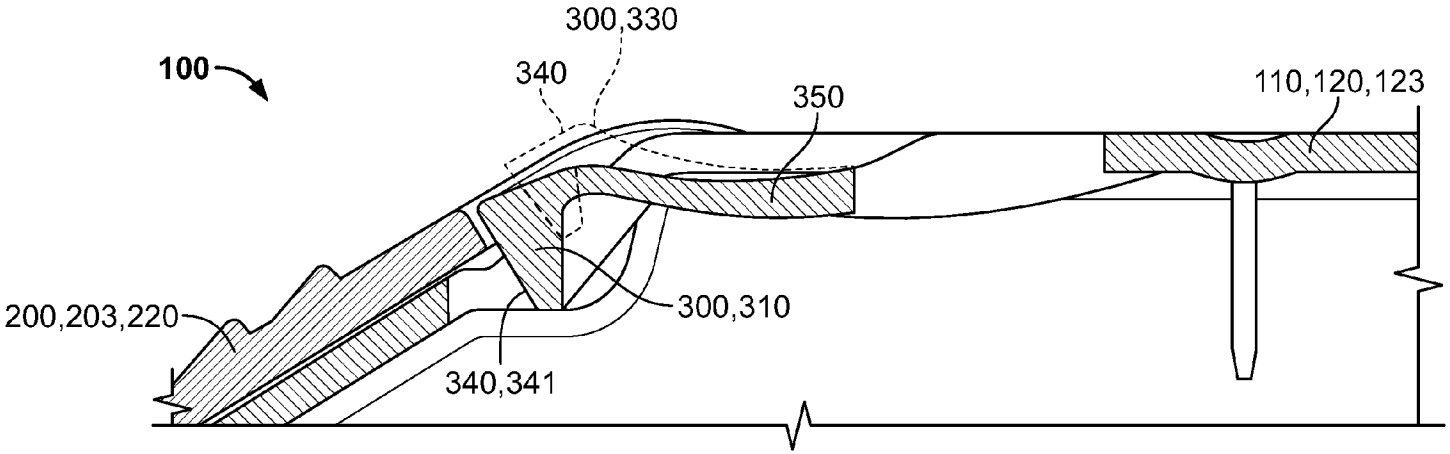
FIG. 4 is a section through the cap with the locking device in a blocking position and an overload position.

FIG. 4 shows a further section through the cap 120 of the plug connector 100 and the locking device 300. Again, the locking device 300 is shown in its blocking position 310. Furthermore, the locking device 300 is shown in an overload position 330 in broken lines.

If the lever 200 is in the second position 220 and an attempt is made to turn the lever 200 out of the second position 220 into the first position 210 without moving the locking device 300 out of the blocking position 310 into the release position 320 beforehand, the operating region 203 of the lever 200 butts against the contact surface 341 of the latch projection 340. If the lever 200 is nevertheless pressed further in the direction of the first position 210 with great force, the locking device 300 could break off and the plug connector 100 could thus be permanently damaged. For this reason, the locking device 300 is configured such that it can elastically deform out of its blocking position 310 into the overload position 300 shown in FIG. 4. The deformation of the locking device 300 out of the blocking position 310 into the overload position 330 preferably requires a greater force than the deformation of the locking device 300 out of the blocking position 310 into the release position 320. The elastic deformation of the locking device 300 in the overload position 330 is achieved substantially by the bar-shaped section 350 of the locking device 300.

In the overload position 330 of the locking device 300, the contact surface 341 of the latch projection 340 of the locking device 300 is no longer arranged right next to the operating region 203 of the lever 200 which is in the second position 220. Consequently, the operating region 203 of the lever 200 can be guided past the latch projection 340 of the locking device 300 if the locking device 300 is in the overload position 330. If the lever 200 is initially in the second position 220 and is blocked by the locking device 300 which is in the blocking position 310, and if the lever 200 is then moved in the direction of the first position 210 with a force which exceeds a set minimum value, the operating region 203 exerts a force on the contact surface 341 of the latch projection 340 of the locking device 300 by which the locking device 300 is deformed out of its blocking position 310 into its overload position 330, until the operating region 203 of the lever 200 can finally slide past the latch projection 340 and the lever 200 can be moved into the first position 210. Then the locking device 300 moves independently elastically out of the overload position 330 back into the blocking position 310, without the locking device 300 having been damaged.

The force to be applied for moving the locking device 300 out of the blocking position 310 into the overload position 330 is preferably selected to be so large that inadvertent opening of the lever 200 which is locked in the second position 220 is ruled out. Merely in the case of incorrect operation of the plug connector 100, or in the case of a force exerted on the lever 200 for other reasons which is so great that there is a risk of damage to the locking device 300, should the locking device 300 move elastically into the overload position 330 in order to avoid damage to the locking device 300.

Figure 5:
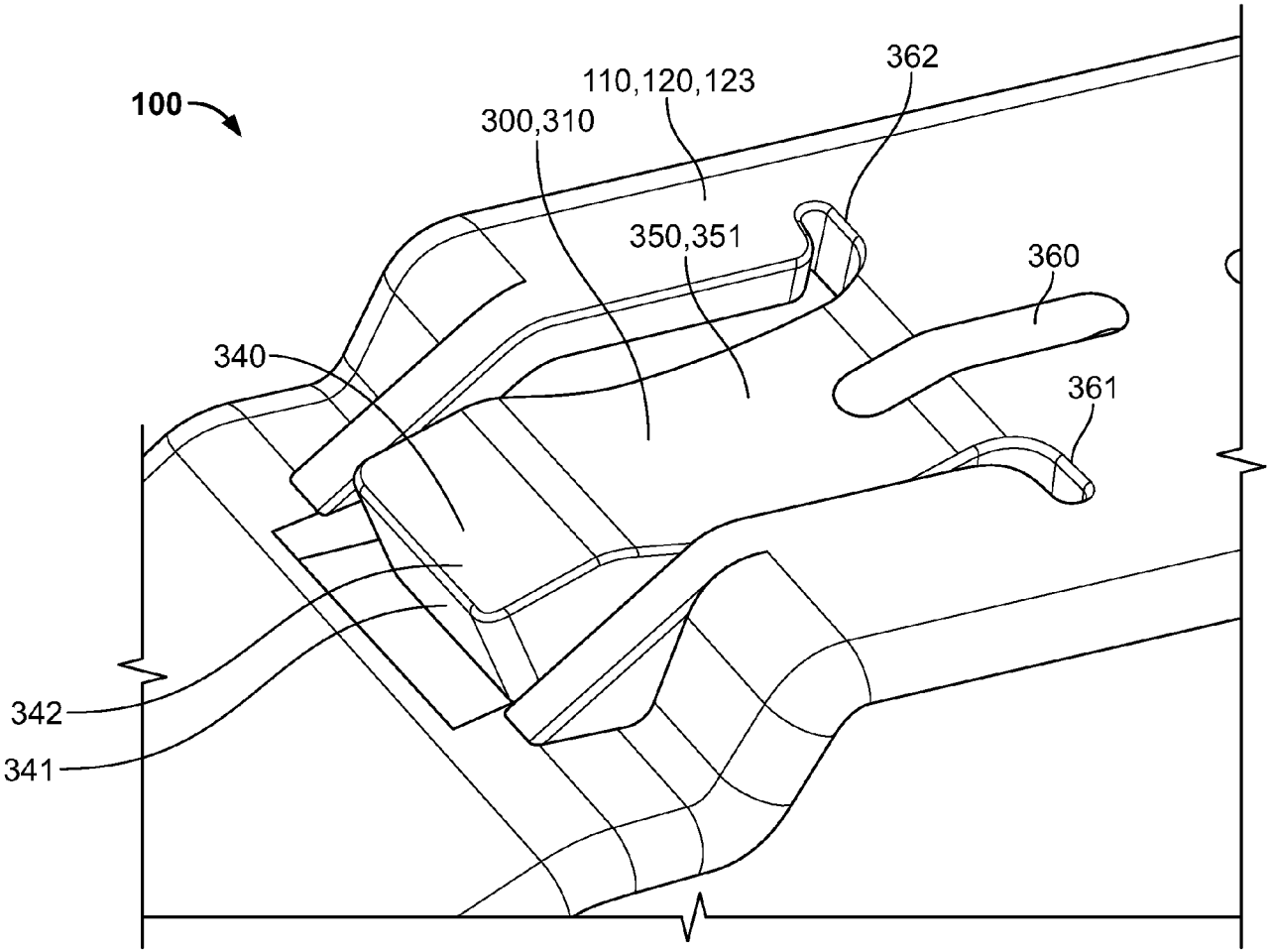
FIG. 5 is a detail view of the locking device.

FIG. 5 shows a detail view of the locking device 300. The locking device 300 is formed in one piece with the cap 120 of the housing 110 of the plug connector 100. The bar-shaped section 350 and the latch projection 340 arranged at one longitudinal end of the bar-shaped section 350 are separated by a first lateral recess 361 and by a second lateral recess 362 from the other sections of the top wall 123 of the cap 120.

The bar-shaped section 350 has a concave section 351 which is curved in the direction of the interior of the housing 110. The concave section 351 increases the elastic deformability of the bar-shaped section 350.

In the transitional region between the bar-shaped section 350 and the top wall 123 of the cap 120 there is provided a middle recess 360 which extends parallel to the bar-shaped section 350 and is arranged centred between the first lateral recess 361 and the second lateral recess 362. The middle recess 360 also improves the elastic deformability of the bar-shaped section 350 of the locking device 300.

Figure 6:
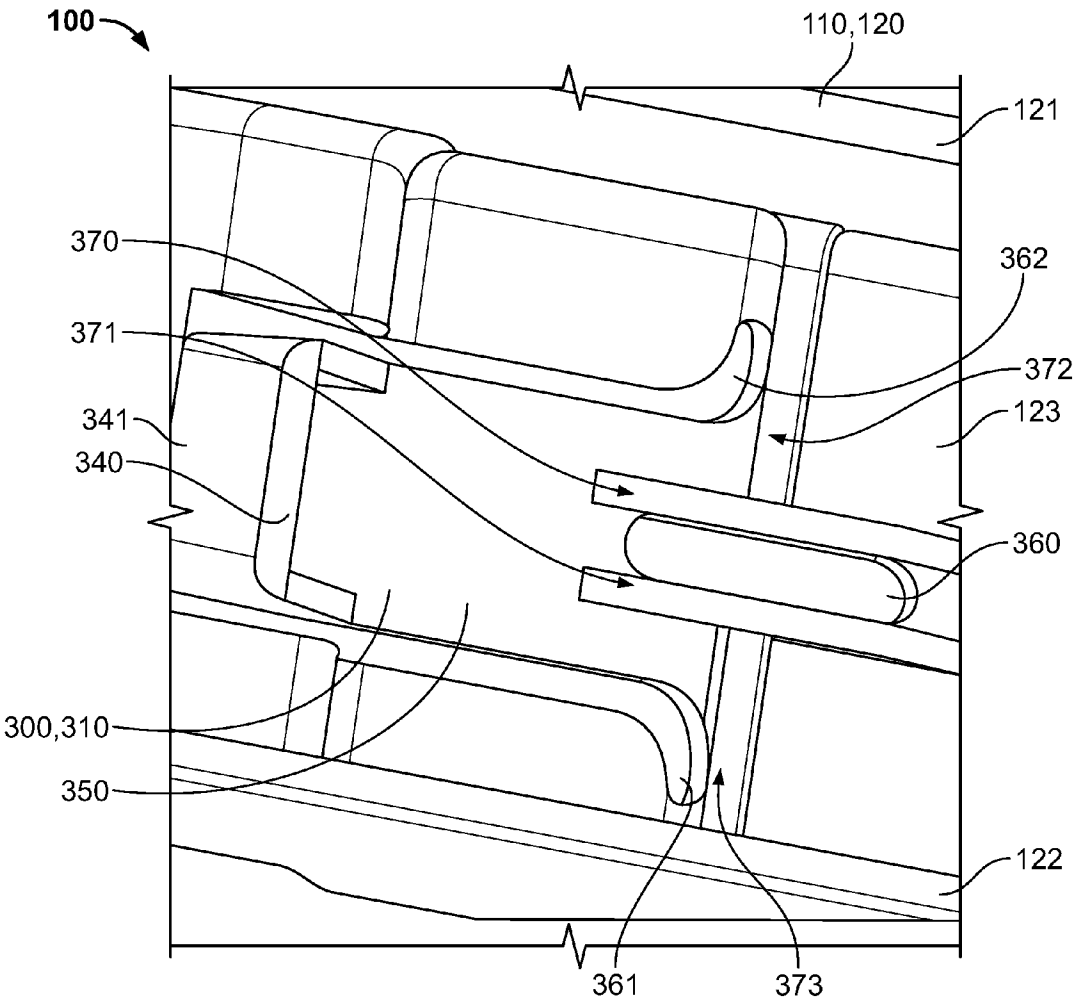
FIG. 6 is a further detail view of the locking device.

FIG. 6 shows a further detail representation of the locking device 300 of the plug connector 100. FIG. 6 shows the locking device 300 viewed from the interior of the housing 110. It can be seen that a first reinforcing rib 370 and a second reinforcing rib 371 are provided in the transitional region between the bar-shaped section 350 of the locking device 300 and the top wall 123 of the cap 120. The first reinforcing rib 370 and the second reinforcing rib 371 are oriented parallel to the middle recess 360 and are arranged on both sides adjacent to the middle recess 360. The first reinforcing rib 370 and the second reinforcing rib 371 are formed in one piece with the locking device 300 and the top wall 123 of the cap 120.

Furthermore, a third reinforcing rib 372 and a fourth reinforcing rib 373 are provided in the transitional region between the bar-shaped section 350 of the locking device 300 and the top wall 123 of the cap 120. The third reinforcing rib 372 and the fourth reinforcing rib 373 are arranged at right-angles to the first reinforcing rib 370 and to the second reinforcing rib 371. The third reinforcing rib 372 extends between the first reinforcing rib 370 and the first side wall 121 of the cap 120. The fourth reinforcing rib 373 extends between the second reinforcing rib 371 and the second side wall 122 of the cap 120.

The reinforcing ribs 370, 371, 372, 373 serve to deflect a force exerted on the locking device 300 partially into the cap 120 of the housing 110 of the plug connector 100, in order to avoid damage to the locking device 300. The reinforcing ribs 370, 371, 372, 373 could however be omitted or be formed differently, as could also the middle recess 360 and the lateral recesses 361, 362.

The cap 120 of the housing 110 of the plug connector 100 preferably consists of plastics material and can be produced by injection moulding. The lever 200 also preferably consists of a plastics-material part produced by injection moulding. The configuration of the locking device 300 with the stabilising reinforcing ribs 370, 371, 372, 373 and the recesses 360, 361, 362 which increase the elasticity also permits the use of an inexpensive plastics material with non-optimum mechanical properties.

The invention claimed is:

1. A plug connector with a housing and with a cap, the cap having a lever which can adopt a first position and a second position, the housing being opened in the first position of the lever and being closed in the second position of the lever, the plug connector having a locking device which can adopt a blocking position which is intended to lock the lever in the second position, the locking device being elastically movable out of its blocking position into a release position in order to unlock the lever in the second position, the locking device having a latch projection and a bar-shaped section, the latch projection being arranged on a longitudinal end of the bar-shaped section and the bar-shaped section having a concave section which is curved in the direction of the interior of the housing to increase the elastic deformability of the bar-shaped section, wherein the locking device is elastically movable out of its blocking position into an overload position in order to unlock the lever in the second position if the locking device is not moved to the release position and a force is exerted on the lever that exceeds a set value, the overload position differing from the release position.

2. The plug connector of claim 1, wherein the lever in its second position is locked by the latch projection.

3. The plug connector of claim 1, wherein the locking device being movable out of the blocking position into the release position by pressing-in the latch projection.

4. The plug connector of claim 1, wherein the locking device has a recess.

5. The plug connector of claim 1, wherein the locking device has a reinforcing rib.

6. The plug connector of claim 1, wherein the lever is pivotable about a rotation spindle.

7. The plug connector of claim 6, wherein the lever has teeth which are arranged along an arc of a circle about the rotation spindle.

8. The plug connector of claim 1, wherein the locking device is arranged on the cap.

9. The plug connector of claim 8, wherein the locking device and the cap are formed in one piece.

10. The plug connector of claim 1, wherein the cap and/or the locking device consist of plastics material.

11. The plug connector of claim 10, wherein the cap and/or the locking device are produced by injection moulding.

12. The plug connector of claim 1, wherein the lever is rotatable into the latch projection of the locking device and the locking device is elastically movable out of its blocking position into the overload position.

13. The plug connector of claim 1, wherein the bar-shaped section of the locking device buckles in the longitudinal direction at the concave section in the overload position.

14. A plug connector with a housing and with a cap, the cap having a lever which can adopt a first position and a second position, the housing being opened in the first position of the lever and being closed in the second position of the lever, the plug connector having a locking device which can adopt a blocking position which is intended to lock the lever in the second position, the locking device depending from a top surface of the cap and being elastically movable out of its blocking position into a release position in order to unlock the lever in the second position, the locking device having a latch projection and a bar-shaped section, the latch projection being arranged on a longitudinal end of the bar shaped section and the bar-shaped section having a concave section which is curved in the direction of the interior of the housing with a top surface of the bar-shaped section being inward of the top surface of the cap when in the blocking position, wherein the locking device is elastically movable out of its blocking position into an overload position in order to unlock the lever in the second position if the locking device is not moved to the release position and a force exerted on the lever exceeds a set value, the overload position differing from the release position.

15. The plug connector of claim 14, wherein the lever in its second position lies against the latch projection.

16. The plug connector of claim 14, wherein the locking device being movable out of the blocking position into the release position by pressing-in the latch projection.

17. The plug connector of claim 14, wherein the locking device has a recess.

18. The plug connector of claim 14, wherein the locking device has a reinforcing rib.

19. The plug connector of claim 14, wherein the lever is pivotable about a rotation spindle.

20. The plug connector of claim 19, wherein the lever has teeth which are arranged along an arc of a circle about the rotation spindle.

21. The plug connector of claim 14, wherein the lever is rotatable into the latch projection of the locking device and the locking device is elastically movable out of its blocking position into the overload position.

22. The plug connector of claim 14, wherein the bar-shaped section of the locking device buckles in the longitudinal direction at the concave section in the overload position.

* * * * *